United States Patent [19]

Saunders

[11] Patent Number: 4,620,524

[45] Date of Patent: Nov. 4, 1986

[54] ADJUSTABLE ANCHOR TAB

[76] Inventor: Charles A. Saunders, 8380-36th Ave., Columbus, Nebr. 68601

[21] Appl. No.: 729,243

[22] Filed: May 1, 1985

[51] Int. Cl.[4] ..... F41C 19/00; A41D 45/10

[52] U.S. Cl. ..... 124/35 A; 2/21

[58] Field of Search ..... 124/23 R, 24 R, 35 A; 2/21

[56] References Cited

U.S. PATENT DOCUMENTS

| | | | |
|---|---|---|---|
| 2,084,634 | 6/1937 | Flury | 124/35 A |
| 3,291,111 | 12/1966 | Smith | 124/23 R |
| 4,332,233 | 6/1982 | Knoble | 124/35 A |

OTHER PUBLICATIONS

An 8×11 sheet with three color photographs attached showing Swedish prior art identified on page 2 of the application.

*Primary Examiner*—Richard C. Pinkham

*Assistant Examiner*—Benjamin Layno

*Attorney, Agent, or Firm*—Henderson & Sturm

[57] ABSTRACT

An improved archery tab having a thin flexible member adapted to be disposed between an archer's fingers and a bow string for protection of the fingers while drawing a bow. A loop is disposed on one side of the member for receivably holding one finger of the hand and an arrow contact slot is disposed on the other side of the member for contact with an arrow nocked onto a bow string. A spacer is attached to intermediate portion of the thin flexible member and has a surface thereon for abutment with the underside of an archer's chin. An adjusting mechanism is provided for adjusting the vertical distance between the top surface of the spacer and the arrow contact means structure. A vertically disposed abutment structure is connected to the top of the spacer for abutting a side of the archer's chin for insuring that the anchoring point on the archer's face is the same every time that the bow is drawn.

1 Claim, 6 Drawing Figures

ADJUSTABLE ANCHOR TAB

TECHNICAL FIELD

The present invention relates generally to archery equipment and more particularly to an adjustable anchor tab for insuring that an archer will anchor at precisely the same place every time.

BACKGROUND ART

Archery tabs are utilized primarily for the purpose of protecting the fingers of an archer's hand while pulling the string back, and also for permitting a smooth release of the string without having it catch on a person's fingers, which causes inaccurate shooting.

In order to shoot a bow accurately, an archer must draw the bow string back and anchor the draw string hand against the archer's face at precisely the same place for every shot. If the archer anchors too high, the shot will be too low; and if the archer anchors too low, compared to the normal anchor position, the shot will be too high. Similarly, if an archer anchors to the left or to the right with respect to the archer's normal anchoring position, the shot will go to a respective side of the desired target in proportion to the anchoring misalignment.

A Swedish manufactured tab has been utilized which has a top surface thereon for abutment with the bottom of an archer's chin, and this surface is adjustable vertically with respect to the tab itself. This tab works fine in order to insure that the anchor is precisely the same vertically from one shot to the next, but it does not help with respect to the lateral adjustment situation referred to above. Consequently, there is a need for an adjustable tab which will not only insure positive vertical alignment of the anchoring point, but also one which will insure a positive anchor point with respect to the lateral position on the face of the archer.

DISCLOSURE OF THE INVENTION

The present invention relates to an improved archery tab having a thin flexible member adapted to be disposed between an archer's fingers and a bow string for protection of the fingers while drawing a bow. A loop is disposed on one side of the member for receivably holding one finger of the hand and an arrow contact slot is disposed on the other side of the member for contact with an arrow nocked onto a bow string. A spacer is attached to intermediate portion of the thin flexible member and has a surface thereon for abutment with the underside of an archer's chin. An adjusting mechanism is provided for adjusting the vertical distance between the top surface of the spacer and the arrow contact means structure. A vertically disposed abutment structure is connected to the top of the spacer for abutting a side of the archer's chin for insuring that the anchoring point on the archer's face is the same every time that the bow is drawn.

An object of the invention is to provide an adjustable archery tab which positively insures the desired anchor point laterally as well as vertically.

Other objects, advantages and novel features of the present invention will become apparent from the following detailed description of the invention when considered in conjunction with the accompanying drawings.

BEST MODE FOR CARRYING OUT THE INVENTION

Figure 2:
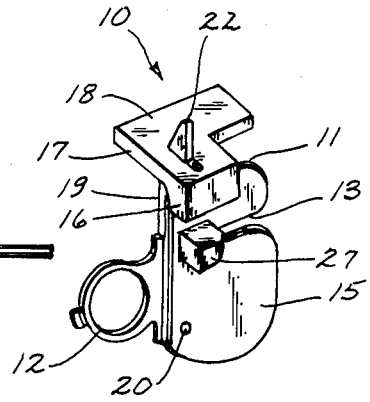
FIG. 2 is a perspective view of a positive anchor tab constructed in accordance with the present invention.
Figure 3:
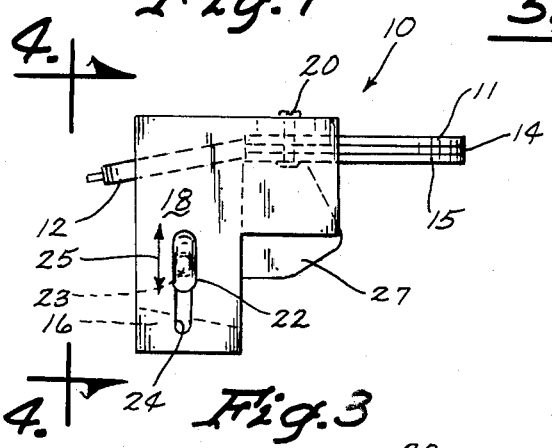
FIG. 3 is a top plan view of a preferred embodiment of the present invention.
Figure 4:
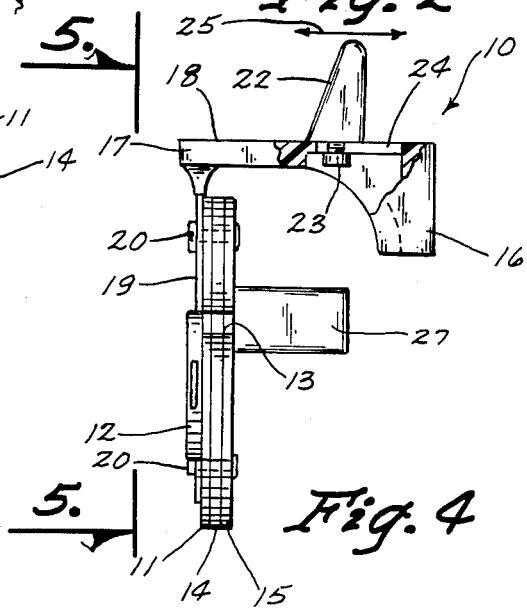
FIG. 4 is a side elevational view taken along line 4—4 of FIG. 3.

Referring now to the drawings wherein like references numerals designate identical or corresponding parts throughout the several views, FIG. 2 shows an adjustable tab (10) constructed in accordance with the present invention. The tab (10) has a molded plastic flap portion (11) with a loop (12) on one side thereof for receiving the middle finger of a hand and a slot (13) for receiving an arrow (14) therethrough. Referring to FIGS. 4 and 6, it is noted that a second flexible felt member (14) is sandwiched between the flexible plastic member (11) and another flexible plastic member (15). These three members (11), (14) and (15) are connected together by rivets (16) as shown in FIGS. 2 and 5.

A metal housing member (16) having a top horizontal leg (17), a top surface (18) and a downwardly extending leg (19) is attached to the tab layers (11), (14) and (15) by threaded fasteners (20) which extend through elongated openings (21) in downwardly extending leg (19). An upwardly extending hard plastic member (22) is secured to the metal housing (16) by a threaded bolt (23) extending through an elongated slot (24) in the leg (17) of the housing (16). When the bolt (23) is loosened, the hard plastic member (22) will move to the left or right as shown by the arrow (25) in FIG. 4, and the bolt (23) will move accordingly in the slot (24) in FIG. 4. When the member (22) is at the desired location left to right as shown in FIG. 4, then the bolt (23) is tightened down to hold member (22) in such desired position with respect to top surface (18) of the housing (16).

Figure 1:
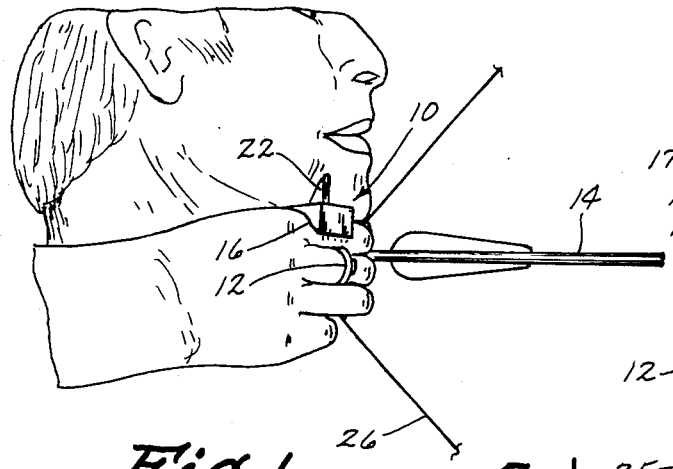
FIG. 1 shows a side elevational view of an archer utilizing the adjustable positive anchor tab of the present invention.
Figure 5:
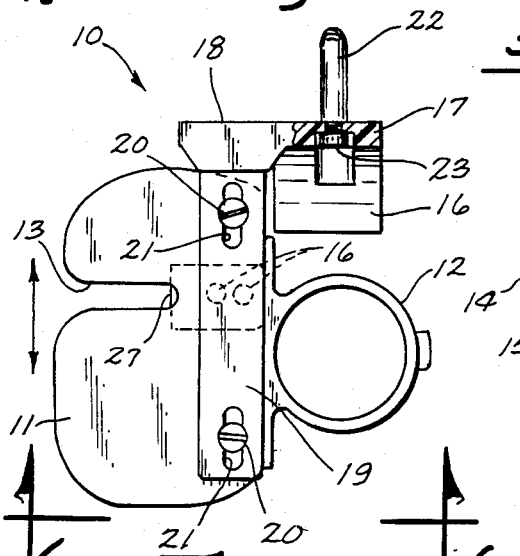
FIG. 5 is a view of the preferred embodiment of the present invention taken along line 5—5 of FIG. 4.
Figure 6:
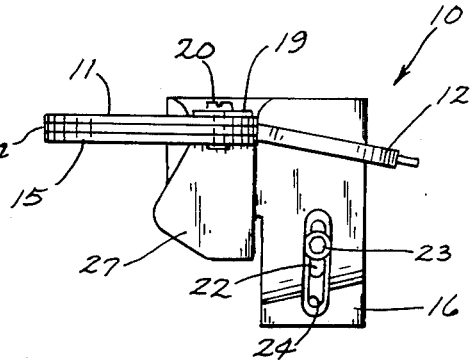
FIG. 6 is a view of the preferred embodiment of the present invention taken along line 6—6 of FIG. 5.

In operation, the middle finger is placed through the opening in ring (12) for example looking at FIG. 5, and the top three fingers of the hand extend adjacent to and in abutment with the flexible plastic member (15). The arrow, nocked onto the string (26) of a bow (not shown) will then be in abutment with the flexible plastic member (11) shown in FIGS. 1 and 5. The tab (10) is held so the surface (18) is held against the bottom of the archer's chin and the leftmost edge of the member (22), in the right hand model shown in FIG. 1, is adjacent to and in abutment with the desired place on the chin of the archer. If it is desired to move the vertical position of the arrow (14) with respect to this anchor point, then a vertical adjustment can be made by loosening the screws (20) and moving the tab (11), (14) and (15) up or down as desired with respect to housing (16).

If it is desired to move the position of the arrow at the anchor point laterally left or right, then the bolt (23) is loosened and an appropriate adjustment is made with respect to member (22). Once such adjustment is made, the bolt (23) is tightened down again to lock member

(22) securely in such desired position. It will be apparent to those skilled in this art that this arrangement does indeed accomplish the aforementioned objects.

Obviously, many modifications and variations of the present invention are possible in light of the above teachings. It is therefore to be understood that, within the scope of the appended claims, the invention may be practiced otherwise than as specifically described.

I claim:

1. An improved archery tab comprising:

a thin flexible member adapted to be disposed between an archer's fingers and a bow string for protection of the fingers while drawing a bow;

means on one side of said member for receivably holding at least one finger of said hand;

arrow contact means on the other side of said member for contact with an arrow nocked onto a bow string;

spacer means attached to an intermediate portion of said member, said spacer means having a surface thereon for abutment with the underside of an archer's chin;

means for adjusting the vertical distance between said surface and said arrow contact means and locking said spacer means with respect to said member;

generally vertically disposed abutment means connected to said spacer means for abutting the side of the archer's chin for insuring that the anchoring point on the archer's face is the same every time that a bow is drawn;

means for adjusting the horizontal position of said vertically disposed abutment means with respect to said surface of the spacer means; and means for selectively locking the horizontal adjusting means in a desired position.

* * * * *